US005853853A

United States Patent [19]

Nishihara et al.

[11] Patent Number: 5,853,853

[45] Date of Patent: Dec. 29, 1998

[54] FLAT FILAMENTS PROVIDED WITH RIBS AND RAW FIBERS FOR PILE FABRICS

[75] Inventors: Yoshihiro Nishihara, Hiroshima; Hideo Masaoka, Osaka; Fumio Takemoto, Hiroshima; Seizo Oishi, Hiroshima; Hiroshi Hosokawa, Hiroshima, all of Japan

[73] Assignee: Mitsubishi Rayon Co., Ltd., Japan

[21] Appl. No.: 843,120

[22] Filed: Apr. 25, 1997

[51] Int. Cl.[6] ..... B32B 3/28; D02G 3/00

[52] U.S. Cl. ..... 428/167; 428/213; 428/364; 428/369; 428/397

[58] Field of Search ..... 428/364, 167, 428/397, 156, 113, 213, 369

[56] References Cited

U.S. PATENT DOCUMENTS

| | | | |
|---|---|---|---|
| 3,310,454 | 3/1967 | Florio et al. | 428/167 |
| 4,797,313 | 1/1989 | Stulk | 428/156 |

FOREIGN PATENT DOCUMENTS

| | | | |
|---|---|---|---|
| 22169711 | 6/1990 | Japan | D01F 6/18 |
| 52200808 | 8/1990 | Japan | D01D 5/253 |
| 16081207 | 3/1994 | Japan | D01D 5/253 |
| 36346318 | 12/1994 | Japan | D01F 6/38 |
| 47034321 | 2/1995 | Japan | D01F 6/18 |

*Primary Examiner*—Donald Loney
*Attorney, Agent, or Firm*—Morrison Law Firm

[57] ABSTRACT

Flat filaments have a flatness (A/B) of 7 to 25, where A is a length of at least one of the two longer sides of a substantially rectangular, transverse cross-section of each filament and B is a length of at least one of the two shorter sides of the substantially rectangular, transverse cross-section of each filament. The flat filaments also have a fineness of 0.5 to 40 denier, and are provided on each of the two longer sides with one or more ribs continuously extending in a direction of an axis of the filament and having a width W and a height H. The number of the ribs on each longer side ranges from 1 to A/2W, the rib width W ranges from B/2 to 3B, and the rib height H ranges from B/2 to 2B. The filaments have excellent nontackiness and bulkiness and permit easy elimination of crimps by polishing, and can be suitably used as raw fibers which, when formed into a pile product, provide the pile product not only with a soft feeling but also with resilient and substantial feeling.

15 Claims, No Drawings

FLAT FILAMENTS PROVIDED WITH RIBS AND RAW FIBERS FOR PILE FABRICS

BACKGROUND OF THE INVENTION

The present invention relates to filaments useful as a raw material for a pile product, and also to raw fibers for pile fabrics. More specifically, the present invention relates to flat filaments which are provided with ribs. The flat filaments provide excellent bulk and an excellent brushing effect, that is, they remain free from mutual cohesion or tangling. The flat filaments can provide both soft surface texture and resilient and substantial texture, and are suitable for pile products such as stuffed toy animals, interior furnishings and clothing. Additionally, raw fibers containing the flat filaments can be included in compositions for pile fabrics. The pile products so obtained exhibit both soft surface texture and excellent resilient and substantial texture.

Natural fur is generally composed of hairs which are reduced in diameter at their free end portions compared to their basal end portions. As a result, the surface of natural fur gives a characteristic soft and flexible texture despite its resilient and substantial appearance.

It has become desirable in recent years to avoid use of natural furs, because of concerns about protection of the natural environment and animals. This has led to a strong demand for the development of pile products which are made of synthetic fibers, have surfaces with a soft texture comparable to that available from natural furs and which, when pressed, exhibit good resiliency and substantial bulk.

Among synthetic fibers, acrylic fibers can provide particularly soft texture. Many pile products which are made of acrylic fibers and which resemble natural fur therefore have been put on the market. However, the use of fibers having a constant thickness results in coarse and hard texture when fibers are formed with the same thickness as that of their basal portions. In the alternative, fibers formed with the same thickness as their free end portions have a non-resilient texture.

The following are examples of the prior art which provide pile products closer in texture to natural furs, due to the use of synthetic fibers:

(1) a technique making use of fibers having a flattened cross-section or an elongated circular cross-section, which are readily bent in at least one direction and give softer touch texture compared with fibers having the same fineness but a circular cross-section (for example, Japanese Patent Laid-Open No. 59524/1975);

(2) a technique wherein free end portions of piles of a pile product, made of polyester fibers, are pointed by dipping and hydrolyzing the free end portions in an aqueous alkali solution (Japanese patent Laid-open No. 16906/1980) or free end portions of bundled polyester fibers are pointed by dipping the free end portions in an aqueous alkali solution (Japanese Patent Laid-Open No. 134272/1981);

(3) a technique wherein fibers with characteristic soft touch texture independent of the thickness of their basal portions are obtained by spinning fibers having a Y-shaped cross-section and applying force to the fibers so the that free end portions of the fibers are split (Japanese Patent Publication No. 51564/1989); and (4) a technique wherein fibers, which have a fineness in a range of from 1.5 to 4 denier, a flattened rectangular cross-section, are bendable in the direction of their shorter sides, and have 1 to 6 asperities on an outer periphery of each fiber, are used to provide a pile product with improved soft surface texture and brushing effect (Japanese Patent Laid-Open No. 200808/1990).

The prior art approaches (1) to (4) all attempt to achieve both soft surface texture and resilient and substantial texture without using downy hairs. Specifically, according to technique (1), indentations are formed as viewed in an elongated circular cross-section so that the inherent tacky texture of polyester fibers can be improved. However, the resulting texture is more or less that available from the untreated fibers. The product of this technique does not exhibit a soft surface texture or resilient and substantial texture comparable to those of natural furs.

A drawback to the method of technique (2) is that the sharpness of fibers is difficult to control. Moreover, the hydrolysis in the aqueous alkali solution must be performed batchwise; therefore, the efficiency of production is poor. Further, the product of technique (3) possesses a cross-sectional shape responsible for a high water retention, which creates a high drying load. For industrial use, special care must be taken. It is therefore difficult for this technique to achieve mass production at a low cost.

Finally, a drawback to technique (4) is that the fibers tend to bend in the direction of the short sides thereof as viewed in their cross-section. Because of the provision of the asperities, the fibers exhibit undesirably high stiffness.

According to the description of the examples in their specifications, the fibers produced by techniques (1) through (4) are stated to provide pile fabrics with greater bulkiness, owing to the avoidance of close contact between the adjacent fibers compared with fibers having a "simple flat cross-sectional shape". However, such pile fabrics lack soft surface texture.

In addition to techniques (1) to (4) described above, another method is known wherein a pile product is formed using raw fibers composed in a combination of non-shrinkable fibers and shrinkable fibers. Only the shrinkable fibers are then caused to shrink by exposing the combination to dry hot or wet hot conditions. As a result, the non-shrinkable fibers and the shrunken fibers act as guard hairs and downy hairs, respectively.

It is preferable for a pile product to have a surface which has soft texture but, when pressed, gives resilient and substantial texture. To provide the surface of the pile product with soft texture, it is important to eliminate crimps from guard hairs, which are buried in downy hairs. Alternatively, the crimped guard hairs may be converted into readily straightenable fibers by a so-called polishing step, in which the surface of the pile product is gently rubbed by a hot roller after shrinkage of shrinkable fibers to produce downy hairs.

To this end, it is known to reduce the proportion of acrylonitrile in an acrylonitrile copolymer to be employed for the production of the fibers, so that the acrylonitrile copolymer can be provided with a reduced thermal distortion temperature. If the copolymerized amount of acrylonitrile in an acrylonitrile copolymer is reduced, the dye clarity and colorability of the fibers are also reduced. Moreover, the texture of the pile product is prone to change through mild thermal treatments, such as drying or the like. The pile product so obtained is therefore difficult to handle.

According to this technique, downy hairs are responsible for the resilient and substantial texture when the pile is pressed. Hence, the shrinkage factor of the fibers and their bulkiness and substantial texture, which are associated with the cross-sectional shape of the shrinkable fibers, become important factors.

To overcome these problems, Japanese Patents Laid-Open Nos. 21978/1985 and 209048/1985 disclose a technique wherein shrinkable fibers, which have a shrinkage factor of at least 15% and an interfibers static friction coefficient of 0.23 or smaller, are used as downy hairs in piled products. To maintain the static friction coefficient below 0.23, an aminosiloxane softener is an essential requirement. However, an aminosiloxane softener tends to deposit in a rubbery form on drying rollers during the drying step of a fiber spinning process. This approach therefore leads to substantial and disadvantageous processing difficulties. A technique which does not use such a softener is therefore desirable.

OBJECTS AND SUMMARY OF THE INVENTION

Accordingly, it is an object of the present invention to overcome the limitations of the prior art.

It is another object of the present invention to provide fibers comprising flat filaments provided with ribs (hereinafter called "ribbed flat filaments"), which exhibit excellent bulk and an excellent brushing, permit easy elimination of crimps by polishing, and when formed into pile products, have soft texture and exhibit resilient and substantial texture.

It is another object of the present invention to provide ribbed flat filaments which may be used as raw fibers for pile fabrics, and which are suitable for stuffed toy animals, interior furnishings, clothing and the like.

It is another object of the present invention to provide raw fibers for piled fabrics, which contain the above ribbed flat filaments and which, when formed into pile fabrics, exhibit a softer texture.

It is another object of the present invention to provide raw fibers, which comprise ribbed flat filaments and specific shrinkable fibers, that do not require blending of raw fibers subjected to special treatment such as application of an aminosiloxane softener, and which can produce pile products having a soft surface texture and excellent resilient and substantial texture, similar to that available from natural furs.

In a first aspect of the present invention, there is thus provided a flat filament having a flatness (A/B) of 7 to 25, A being a length of at least one of the two longer sides and B being a length of at least one of the two shorter sides of the substantially rectangular, transverse cross-section of the filament, and having a fineness of 0.5 to 40 denier; and provided on each of the two longer sides with one or more ribs continuously extending in a direction of an axis of the filament, the ribs having a width W and a height H, the number of the ribs on each longer side ranging from 1 to A/2W, the width W ranging from B/2 to B, and the height H ranging from B/2 to 2B.

In a second aspect of the present invention, there are also provided raw fibers for a pile fabric, which comprise at least 10 wt. % of ribbed flat filaments as defined above; and at most 90 wt. % of a second flat filament having a flatness (A'/B') of 5 to 25, A' being a length of at least one of the two longer sides, and B' being a length of at least one of the two shorter sides of the substantially rectangular, transverse cross section of the second filament, and the second filament having a fineness of 1 to 40 denier.

In a third aspect of the present invention, there are also provided raw fibers for a pile fabric, which comprise 20 to 60 wt. % of ribbed flat filaments as defined above; 20 to 50 wt. % of a shrinkable second fiber having a shrinkage factor of at least 15% and a fineness of 1 to 5 denier; and 60 wt % or less of a third non-shrinkable fiber.

Briefly stated, flat filaments have a flatness (A/B) of 7 to 25, where A is a length of at least one of the two longer sides of a substantially rectangular, transverse cross-section of each filament and B is a length of at least one of the two shorter sides of the substantially rectangular, transverse cross-section of each filament. The flat filaments also have a fineness of 0.5 to 40 denier, and are provided on each of the two longer sides with one or more ribs continuously extending in a direction of an axis of the filament and having a width W and a height H. The number of the ribs on each longer side ranges from 1 to A/2W, the rib width W ranges from B/2 to 3B, and the rib height H ranges from B/2 to 2B. The filaments have excellent nontackiness and bulkiness and permit easy elimination of crimps by polishing, and can be suitably used as raw fibers which, when formed into a pile product, provide the pile product not only with a soft feeling but also with resilient and substantial feeling.

According to an embodiment of the present invention, a flat filament has a substantially rectangular transverse cross-section, wherein the filament includes a flatness ratio (A/B) of 7 to 25, wherein A is a length of a longer side of the substantially rectangular, transverse cross-section, and B is a length of a shorter side of the substantially rectangular, transverse cross section, a fineness of 0.5 to 40 denier, at least one rib formed on the longer side, the at least one rib continuously extending in a longitudinal direction of the filament, and each of the at least one rib having a width W and a height H, the number of the ribs on each longer side ranging from 1 to A/2W, the width W ranging from B/2 to 3B, and said height H ranging from B/2 to 2B.

According to another embodiment of the present invention, raw fibers for manufacture of a pile fabric, the raw fibers comprises at least 10 wt. % of a first ribbed flat filament having a first substantially rectangular transverse cross-section, wherein said first ribbed flat filament includes: a flatness ratio (A/B) of 7 to 25, wherein A is a length of a longer side of the first substantially rectangular, transverse cross-section, and B is a length of a shorter side of the first substantially rectangular, transverse cross section, a fineness of 0.5 to 40 denier, at least one rib formed on the longer side, the at least one rib continuously extending in a longitudinal direction of the filament, each of the at least one rib having a width W and a height H, the number of the ribs on each longer side ranging from 1 to A/2W, the width W ranging from B/2 to 3B, and the height H ranging from B/2 to 2B, and not more than 90 wt. % of a second flat filament having a second substantially rectangular transverse cross-section, wherein the second flat filament includes: a flatness ratio (A'/B') of 5 to 25, A' being a length of a longer side of the second substantially rectangular, transverse cross-section, and B' being a length of a shorter side of the second substantially rectangular, transverse cross-section, and a fineness of 1 to 40 denier.

According to another embodiment of the present invention, raw fibers for a pile fabric, the raw fibers comprises: 20 to 60 wt. % of a first ribbed flat filament having a first substantially rectangular transverse cross-section, wherein the first ribbed flat filament includes: a flatness ratio (A/B) of 7 to 25, wherein A is a length of a longer side of the first substantially rectangular, transverse cross-section, and B is a length of a shorter side of the first substantially rectangular, transverse cross section, a fineness of 0.5 to 40 denier, at least one rib formed on the longer side, the at least one rib continuously extending in a longitudinal direction of the filament, each of the at least one rib having a width W and a height H, the number of the ribs on each longer side ranging from 1 to A/2W, the width W ranging from B/2 to 3B, and the height H ranging from B/2 to 2B, 20 to 50 wt. % of a shrinkable fiber having a shrinkage factor of at least 15% and a fineness of 1 to 5 denier, and 60 wt % or less of a non-shrinkable fiber.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The ribbed flat filament according to the present invention is required to have a flatness of 7 to 25 as defined by a ratio of A/B, where A is a length of at least one of the two longer sides of a substantially rectangular, transverse cross-section of the filament, and B is a length of at least one of the two shorter sides of the substantially rectangular, transverse cross-section of the filament. A flatness of 7 to 15 is preferable. The cross-section is defined as being perpendicular to an axis of the filament.

The term "substantially rectangular" is used herein to define the shape of a cross-section of a base portion (i.e., a portion which still remains after removal of the ribs) of the ribbed flat filament according to the present invention. The preferred shape is substantially rectangular. However, the present invention should be interpreted to embrace not only rectangular shapes but also other shapes such as oval shapes, insofar as they can achieve the above-described objects of the present invention by meeting, for example, the flatness ratio requirement. In such oval shapes, the flatness ratio A/B accordingly corresponds to the aspect ratio of the major and minor axis of the oval. Furthermore, the ribs formed are accordingly formed on the sides of the oval that corresponds to the major axis of the oval which is measured through the two foci.

Shapes that are not strictly oval or rectangular nevertheless are included within the scope of the present invention. The flatness ratio of such shapes' cross-sections is determined by constructing a bounding rectangle that contacts the cross-sectional shape at a longer major axis at at least two points and at a perpendicular shorter minor axis at at least two points, with the perimeter of the bounding rectangle minimized to a minimum value. The axis are rotated until the resulting bounding rectangle perimeter is at the minimum. The thus formed bounding rectangle is then measured to calculate the flatness ratio A/B.

A flatness less than 7 is not preferred because such filaments tend to tangle with each other and, when formed into a pile product, result in a surface having a rough texture. On the other hand, filaments having a flatness greater than 25 are difficult to form into a pile product, because such filaments have lower mechanical strength due to a reduction in stretchability upon spinning.

It is required for the filament to be provided on each of the two longer sides with at least one rib as viewed in the transverse cross-section of the filament. The rib is required to continuously extend in a direction of the axis of the filament and to have a width W and a height H, the width W ranging from B/2 to 3B and the height H ranging from B/2 to 2B.

Because of these ribs which continuously extend in the direction of the longitudinal axis of the filament, adjacent filaments remain loose without cohesion, thereby having excellent brushing effect and bulkiness and, when formed into a pile product, exhibiting a soft texture and even resilient and substantial texture.

If the width W of the ribs is less than B/2 or greater than 3B, or if the height H of the ribs is less than B/2, the effects of ribs cannot be observed, so that the filaments merely show texture and brushing qualities which are not different at all from those available from simple flat filaments. If the height H of the ribs exceeds 2B, such filaments cannot be produced with good productivity.

Further, the number of ribs per longer edge of the filament should be an integer in a range of 1 to A/2W. If the number n of these ribs exceeds A/2W, little space is left among the adjacent filaments, so that the brushing effect is reduced. As a result, the texture is not different at all from that available when filaments of a simple flat cross-section are used.

The fineness ("fineness" as used herein means "the fineness of a single filament") of the ribbed flat filament according to the present invention should be 0.5 to 40 denier, with 2 to 25 denier being preferred and 3 to 20 denier being particularly preferred. A fineness less than 0.5 denier is not preferred because such filaments tend to tangle with each other and, when formed into a pile product, result in a surface having a rough texture. On the other hand, a fineness greater than 40 denier texture when formed into a pile product.

No particular limitation is imposed on the position of each rib in the ribbed flat filament, insofar as it is located on the longer side of a basal portion of the filament. From the standpoint of texture, it is particularly preferable that a midpoint of a width of the rib is located within a distance of A/4 from a midpoint of the longer edge.

Although no particular limitation is imposed on the cross-sectional shape of each rib, the rib preferably has a cross-sectional rib shape that does not form any pocket between the rib and the basal portion of the filament, since the water retention can be controlled at a low level in a spinning step. Illustrative examples of permitted cross-sectional rib shapes include triangular, square, rectangular, as well as other polygonal and semicircular shapes. In particular, a cross-sectional shape defined by curved lines without edges is preferred, because such raw filaments also exhibit good cohesion in a spinning step. Moreover, when formed into a pile product, mutual hooking of the filaments is reduced and the pile product is provided with a still softer surface texture.

The term "cohesion" as used herein indicates whether or not any disadvantage, such as sliver breakage, takes place when forming such filaments into slivers as an intermediate material for the pile product. If the cohesion is poor, it is necessary to make longer the cut length of raw fibers to be spun. When the cross-sectional shape of each rib is formed of curved lines alone, the cut length of the raw fibers can be chosen from a broader range. Therefore, such a cross-sectional shape is advantageous for adjusting the texture.

The preferred ranges of the width W and the height H are within a range of B/2 to 2B, more preferably a range of B to 2B for the width W and a range of B/2 to B for the height H. Setting W and H within these ranges makes it possible to produce filaments with good productivity in the spinning step and further to achieve the best cohesion in the spinning step.

It is also important for the production of a soft surface texture to set the ratio of a total length of flat portions to the length of the longer side in the basal portion of the ribbed flat filament, (A-nW)/A, at as high a value as possible. In the term A-nW, n is the number of ribs on the length A. The value of (A-nW)/A is preferably 0.6 or greater, with 0.7 or greater being more preferred.

The ribbed flat filaments are preferably acrylic filaments made of an acrylonitrile polymer. Among synthetic fibers, acrylic filaments are particularly amenable to producing a soft texture, and are excellent in dye clarity and colorability.

The acrylonitrile polymer suitable for the production of the ribbed flat acrylic filaments is an acrylonitrile copolymer, which is composed of 50 wt. % or more of acrylonitrile and an unsaturated monomer copolymerizable with acrylonitrile. An acrylonitrile content lower than 50 wt. % leads to filaments which are poorer in thermal properties, dye clarity and colorability, When the ribbed flat filaments are used in combination with shrinkable acrylic fibers and/or other acrylic fibers, an acrylonitrile polymer containing acrylonitrile in an amount of 90 wt. % or more is preferred.

Any appropriate unsaturated monomer may be employed as a copolymerizable component. Examples of usable unsaturated monomers include acrylic acid, methacrylic acid and derivatives thereof; vinyl acetate, acrylamide, methacrylamide, vinyl chloride, and vinylidene chloride; and depending on the application, ionic unsaturated monomers such as sodium vinylbenzene sulfonate, sodium methallyl sulfonate, and sodium acrylamidomethylpropanesulfonate, Any appropriate polymerization process for the acrylonitrile polymer may be used. For example, a conventional suspension polymerization or solution polymerization process can be used.

Further, no particular limitation is imposed on the molecular weight of the acrylonitrile polymer, provided that the molecular weight falls within a range of molecular weights generally employed for the production of acrylic filaments. It is however preferred to have a reduced viscosity at 25° C. be within a range of 1.5 to 3.0, when measured in the form of a 0.5 wt. % dimethylformamide solution.

A spinning solution is prepared by dissolving the acrylonitrile polymer in an appropriate solvent so that the concentration of the acrylonitrile polymer falls within a range of 15 to 28 wt. %. The spinning solution is then spun through a spinneret having a hole configuration substantially similar to the desired cross-sectional shape of the filaments. If the concentration of the acrylonitrile polymer in the spinning solution is less than 15 wt. %, the configuration of the fine spinning holes and the cross-sectional shape of the filaments substantially differs from that of the fine spinning holes of the spinneret at the time of coagulation. This makes it difficult to obtain the desired cross-sectional shape. If the concentration exceeds 28 wt. % the spinning solution is less stable over time, so that its spinnable properties are lowered.

Usable examples of the solvent include organic solvents such as dimethylformamide, dimethylacetamide and dimethyl sulfoxide; and other solvents such as nitric acid, aqueous thiocyanate solutions, and aqueous solution of zinc chloride. When it is intended to control the cross-sectional shape of filaments by the configuration of fine-spinning holes, an organic solvent is advantageous. By performing spinning and taking up in such a way that a spinning draft (defined as a ratio of a taking up speed of coagulated filaments to a linear delivery speed of a spinning solution) falls within a range of 0.7 to 2.0, flat acrylic filaments having a cross-sectional shape substantially similar to the configuration of the fine spinning holes can be produced. A spinning draft greater than 2.0 results in more frequent end breakage in the coagulation bath solution, thereby making it difficult to obtain intact filaments.

The coagulated filaments are then stretched, washed and dried under known conditions by known methods, to produce flat acrylic. Depending on the application, the filaments so obtained may be subjected to thermal relaxation treatment or the like to impart well-balanced mechanical properties. The filaments are then cut into raw fibers.

A description will next be made about raw fibers for a pile fabric, which comprise ribbed flat filaments according to the present invention. The ribbed flat filaments have a flatness (A/B) of 7 to 25, where A is a length of at least one of the two longer sides of a substantially rectangular, transverse cross-section of the filaments and B is a length of at least one of the two shorter sides of the substantially rectangular, transverse cross-section of the filaments. The ribbed flat filaments have a fineness of 0.5 to 40 denier. The flat filaments which are blended to the ribbed flat filaments have a flatness (A'/B') of 5 to 25 and a fineness of 1 to 40 denier, preferably of 2 to 30 denier, more preferably of 5 to 15 denier.

If raw fibers for a pile fabric are formed of merely flat filaments alone, the filaments closely cohere as described above so that their brushing effect is reduced and, when formed into a pile product, the pile product has a rough texture. If raw fibers are formed of super flat filaments having a large flatness to impart a softer texture, the resulting pile product, in addition to the above-mentioned drawbacks, also has a lower resiliency.

However, blending of ribbed flat filaments according to this invention with flat fibers results in insertion of the ribbed filaments between the flat filaments. The filaments are therefore prevented from cohering with one another, resulting in an improved brushing effect. Furthermore, as the individual filaments are independent from each other, they can be brought into direct contact with a hot roller when they are heated in a polishing step. This facilitates transfer of heat from the hot roller to the individual filaments so that the elimination of crimps from the filaments is easier than that of crimps from raw fibers composed only of ribbed flat filaments according to the present invention. The resulting pile product is therefore of a structure in which the flat filaments are reinforced by the ribbed flat filaments, so that the pile product has a resilient and substantial texture, while its surface has a soft texture.

If the flatness of the blended flat filaments is less than 5, the flat filaments do not exhibit the softness specific to flatter filaments, thereby making it difficult to obtain a pile product resembling a natural fur. If the flatness exceeds 25, the blended flat filaments have so strong a tendency to cohere to each other that, even when the ribbed flat filaments are blended, the brushing effect of the ribbed flat filaments cannot be improved.

If the fineness of the blended flat filaments is smaller than 1 denier, the filaments tend to tangle with each other so that, when formed into a pile product, the pile product has a rough surface texture. If the fineness exceeds 40 denier, the filaments cannot exhibit a soft texture when they are formed into a pile product. It is therefore difficult to obtain a pile product resembling a natural fur.

Concerning the blending proportions of the ribbed flat filaments to the blended flat filaments, the former should be 10 wt. % or more, more preferably 30 wt. % or more. If this proportion is less than 10 wt. %, the ribbed flat filaments cannot effectively prevent mutual tacking or cohesion of the blended flat filaments. When formed into a pile product, the pile product tends to have a rough surface texture. It should be apparent that the raw fibers for the pile fabric may be composed solely of ribbed flat filaments, according to the present invention.

The flat filaments used to form the raw fibers according to the present invention for the pile fabric are preferably flat acrylic filaments. Among synthetic fibers, the acrylic filaments are more amenable to obtaining a particularly soft texture, and are excellent in dye clarity and colorability. The flat acrylic filaments may be produced in a similar manner as the above-described production process of the ribbed flat acrylic filaments, except that the configuration of the fine spinning holes should be changed to a configuration substantially similar to the cross-sectional shape of the flat acrylic filaments.

Raw fibers for a pile fabric can be obtained by blending the ribbed flat filaments and the flat filaments in the above-described proportions or by using only the ribbed flat filaments. The raw fibers can then be formed into a pile fabric such as a boa, high-pile fabric or carpet.

A description will next be made of raw fibers according to the present invention for a pile fabric, which is composed of a blend of shrinkable fibers and the ribbed flat acrylic filaments. The shrinkable fibers should have a shrinkage factor of at least 15%, and a single fiber fineness of 1 to 5 denier. These raw fibers will hereinafter be called "shrinkable-fiber-blended raw fibers for a pile fabric".

A natural fur exhibits its characteristic resilient and substantial texture not only when pressed firmly, but also when pressed lightly. The feeling of the above-described blend of flat and ribbed flat filaments for a pile fabric is very close to the texture of natural fur when pressed gently, but when pressed strongly, resilient and substantial feeling such as that available from the natural fur cannot be obtained. With a view to further improving the texture, shrinkable filaments which become downy hairs when formed into a pile product are therefore used in combination.

The shrinkable-fiber-blended raw fibers for the pile fabric are obtained by blending the ribbed flat filaments, shrinkable fibers having a shrinkage factor of at least 15% and a single fibers fineness of 1 to 5 denier, and non-shrinkable fibers together. It is necessary to set the proportions of the respective fibers at 20 to 60 wt. % for the ribbed flat filaments, 20 to 50 wt. % for the shrinkable fibers and 60 wt. % or less for the non-shrinkable fibers.

In this case, the ribbed flat: filaments have high stiffness so that they tend to remain upright in the pile fabric. When a hot roller is brought into contact with the ribbed flat filaments upon so-called polishing step in the production process of the pile fabric, the ribbed flat filaments can contact the hot roller without flexion. This makes it possible to improve the efficiency of heat transfer from the hot roller to the ribbed flat filaments; whereby crimps can be easily straightened out.

If the proportion of the ribbed flat filaments in the shrinkable-fiber-blended raw fibers for the pile fabric is smaller than 20 wt. %, it is impossible to provide the resulting pile fabric with a surface of soft feeling. On the other hand, a proportion greater than 60 wt. % makes it difficult to fully draw out the effect of the thus-blended shrinkable fibers, that is, to achieve improvements in the resilient and substantial feeling of the resulting pile fabric when the pile fabric is strongly pressed.

The shrinkage factor of the shrinkable fibers which are converted to downy hairs when formed into the pile fabric is 15% or greater, preferably 20% or greater. A shrinkage factor smaller than 15% leads to fluffs sunken to basal portions of the ribbed flat filaments so that, when strongly pressed, the downy hairs cannot play a role in imparting resilient and substantial feeling to the pile fabric.

The term "shrinkage factor of at least 15% (or 20%)" as used herein indicates that either the wet thermal shrinkage factor or the dry thermal shrinkage factor is at least 15% (or 20%). The wet thermal shrinkage factor is measured after treatment for 3 minutes in boiling water and comparing the pre-treated filaments with post-treated filaments. The dry thermal shrinkage factor is measured after treatament at 130° C. for 10 minutes and comparing the pre-treated filiments with the post-treated filaments.

Non-shrinkable fibers are fibers that manifest shrinkage factors lower than 15%.

If the proportion of the shrinkable fibers in the shrinkable-fiber-blended raw fibers for the pile fabric is smaller than 20 wt. %, the resulting pile fabric cannot exhibit strong resiliency and substantial feeling when strongly pressed. On the other hand, a proportion greater than 50 wt. % leads to a pile fabric whose surface has a low filament density, whereby the pile fabric is not provided with surface smoothness.

The shrinkable fibers are required to have a fineness of 1 to 5 denier. A fineness smaller than 1 denier results in tangling of the shrinkable fibers themselves or tangling of the shrinkable fibers with the ribbed flat filaments as guard hairs, thereby making it difficult to allow the shrinkable fibers to undergo even shrinkage. A fineness greater than 5 denier, on the other hand, results in a pile fabric which is felt rough at the basal portions of its filaments and is hence of lower quality.

Further, if the proportion of the non-shrinkable fibers which may be used in addition to the ribbed flat filaments and the shrinkable fibers as needed exceeds 60 wt. %, the proportions of the ribbed flat filaments as guard hairs and the shrinkable fibers as downy hairs are reduced accordingly, thereby resulting in a pile fabric with a surface whose soft feeling, resiliency and substantial feeling are all reduced.

Moreover, use of shrinkable and/or non-shrinkable fibers having a specific cross-sectional shape as the shrinkable fibers and/or the non-shrinkable fibers leads to a pile fabric of still improved quality.

As the cross-sections of fibers of such a specific cross-sectional shape, it is necessary to concurrently meet the following three requirements.

(1) The contour of each cross-section should be defined only by edge-free curves.

(2) Each cross-section should satisfy the following formula:

$$2 \leqq a/b \leqq 5$$

where, when the cross-section is sandwiched between two parallel straight lines, a is a maximum distance between the two parallel straight lines and b is a minimum distance between the two parallel straight lines. In this formulation, the parallel lines remain fixed in a particular orientation relative to a coordinate system while the cross-section is rotated about a center point. The parallel lines are moved together or apart in order to maintain contact with the cross-section without the cross-section crossing over the parallel lines. The maximum distance apart is determined and represented by a while the minimum distance is determined to be b.

(3) Each cross-section defines at least two indentations at different locations.

When the requirements (1) to (3) are met, the chance of mutual hooking of the single fibers is reduced upon causing the shrinkable fibers to shrink into downy hairs. The shrinkable fibers are therefore allowed to undergo even shrinkage, leading to a pile fabric with still improved, excellent resilient and substantial feeling. It is a role of the non-shrinkable fibers to prevent the ribbed flat filaments from cohering together in the pile fabric so that the pile fabric is provided with stilled improved quality. The cohering-preventing effect of these non-shrinkable fibers can also enhanced further if the contours of their cross-sections are each defined only by curves.

Any fibers available by a known process and having the above-described characteristics are usable as the sinkable fibers in the shrinkable-fiber-blended raw fibers for the pile fabric. No particular limitation is imposed on their production process. Shrinkable acrylic fibers are particularly preferred for their superb dye clarity and colorability.

Shrinkable acrylic fibers can be produced by any convenient process, and provided with a cross-sectional shape which can meet the above-described requirements (1) to (3), when the configuration of fine spinning holes and spinning conditions are suitably selected and combined to obtain shrinkable acrylic fibers of the desired cross-sectional shape.

Concerning the individual types of fibers making up the shrinkable-fiber-blended raw fibers for the pile fabric, no particular limitations are imposed on their spinning steps or on finishing oils which are used in post-treatments after dyeing or the like.

When colored raw fibers are desired, it is only necessary to conduct dyeing by a method known in the art such as dyeing after the formation of the raw fibers, or using of producer dyed fibers or pigmented fibers. The ribbed flat filaments, the shrinkable fibers and, if necessary, the non-shrinkable fibers are blended in the above-described proportions, and as raw fibers for a pile fabric, are formed into a pile product such as a boa, a high-pile fabric or a carpet by a known piling process.

The present invention will hereinafter be described further by the following examples, in which the individual measurement data were measured by the following methods.

Reduced Viscosity of Acrylonitrile Polymer

The reduced viscosity of each acrylonitrile polymer was determined by dissolving it with dimethylformamide into a 0.5 wt. % solution and then measuring its viscosity at 25° C. with a Cannon-Fenske viscometer.

Measurement of Shrinkage Factor

The measurement of the shrinkage factor of each filament was conducted by the following procedures.

The filament length ($L_w$) before shrinkage was measured under a load of 10 mg/denier and subsequent to shrinking processing, the temperature of the filament was allowed to drop down to room temperature and the filament length ($L'_w$) was likewise measured under a load of 10 mg/denier. Its shrinkage factor was then determined in accordance with the following formula:

$$\text{Shrinkage factor } (\%)=((L_w-L'_w)/L_w)\times 100$$

Ranking of Pile Product

Based on the surface softness of each pile product as determined by human hand in an organoleptic test and the resiliency and substantial feeling of the Pile product when the pile product was pressed by hand, the pile product was ranked in accordance with the following standards:

Surface softness:

A: Excellent

B: Good

C: Average

D: Poor

E: Bad

Resiliency and substantial feeling:

A: Excellent (good resiliency and substantial feeling were obtained not only when the pile product was strongly pressed but also when the pile product was lightly pressed).

B: Good (good resiliency and substantial feeling were obtained when the pile product was lightly pressed).

C: Average

D: Poor

E: Bad

Water Retention

After filaments were washed, a sample was collected in a wet state before processing them with drying rollers. The sample was dried at 105° C. for 2 hours. From the weights of the sample before and after drying, its water retention was calculated in accordance with the following formula:

$$\text{Water retention } (\%)=\{(W_1-W_0)/W_0\}\times 100$$

where $W_0$ is the weight (g) of the filaments after drying and $W_1$ is the weight (g) of the filaments before drying.

Positions of Ribs

In each example, the position of each rib was indicated by expressing a midpoint of a bottom side of the rib in terms of coordinates (x,y). The coordinates are located in a coordinate system composed in such a way that a point of intersection between diagonal lines of a substantially rectangular cross-section is located at the origin of coordinate axes x,y. The rectangular cross-section is obtained by cutting the rib along an orthogonal transverse plane, which extends vertically relative to a filament axis of the associated flat filament. The coordinate axis x extends in parallel with both longer sides of the substantially rectangular cross-section while the coordinate axis y extends in parallel with both shorter sides of the substantially rectangular cross-section.

EXAMPLES 1–15 & COMPARATIVE EXAMPLES 1–11

In each of the examples and comparative examples, an acrylonitrile copolymer composed of 93 wt. % of acrylonitrile and 7 wt. % of vinyl acetate and having a reduced viscosity of 2.0 was obtained by an aqueous suspension polymerization process. The acrylonitrile copolymer was then dissolved in dimethylacetamide so that a spinning solution containing the acrylonitrile copolymer at a concentration of 24 wt. % was obtained.

In Comparative Example 1, however, the concentration of the acrylonitrile copolymer was set at 20 wt. %.

Through fine spinning holes, the spinning solution was spun in a 40% aqueous solution of dimethylacetamide. The spinning holes corresponding to a hole configuration similar to the desired cross-sectional shape of the filaments. The aqueous solution is controlled at 40° C., so that the corresponding spinning draft shown in Table 1 was obtained. The resultant filaments were stretched 5-fold in hot water (6.5-fold in Comparative Example 1 only), washed and then dried by drying rollers. After they were subjected to thermal relaxation treatment under a pressurized steam atmosphere of 2.5 kg/cm$^2$, crimps were applied at a population of 9.5 crimps/inch and a crimp degree of 10.3%, whereby ribbed flat acrylic filaments were obtained.

These ribbed flat acrylic filaments were cut into 51 mm lengths to form raw fibers. From the raw fibers, slivers of 10 g/m in thickness were produced. By a sliver knitting machine, they were formed into a sliver knit. The sliver knit was then subjected to a polishing step, whereby a high-pile fabric of a metsuke (basis weight) of 700 g/m$^2$ and a pile length of 18 mm was obtained. Evaluation results of this high-pile fabric are shown in Table 1.

TABLE 1

| | spinning draft | Fineness | A(μ) | B(μ) | Flatness | Positions of ribs | Cross-sectional shape of ribs | Size of ribs (W, H) | Feeling: Surface Feeling | Feeling: Resiliency Substantial Feeling |
|---|---|---|---|---|---|---|---|---|---|---|
| Comp. Ex. 1 | 1.91 | 0.4 | 10.8 | 2.1 | 5 | (0, B/2), (0, −B/2) | Semi-circular | 2B, B | E (Rough feeling) | E |
| Comp. Ex. 2 | 1.63 | 2.0 | 24 | 4.8 | 5 | (0, B/2), (0, −B/2) | Semi-circular | 2B, B | C | C |
| Ex. 1 | 1.15 | 10 | 98 | 7.6 | 13 | (0, B/2), (0, −B/2) | Semi-circular | 2B, B | A (Very Soft) | B |
| Comp. Ex. 3 | 0.95 | 45 | 230 | 15.3 | 15 | (0, B/2), (0, −B/2) | Semi-circular | 2B, B | E (Rough feeling) | B |
| Comp. Ex. 4 | 1.01 | 5.0 | 20.4 | 6.8 | 3 | (0, B/2), (0, −B/2) | Semi-circular | 2B, B | D (Rough feeling) | D |
| Ex. 2 | 1.01 | 5.0 | 56 | 8.0 | 7 | (0, B/2), (0, −B/2) | Semi-circular | 2B, B | A (Very soft) | B |
| Ex. 3 | 1.21 | 15 | 176 | 9.0 | 20 | (0, B/2), (0, −B/2) | Semi-circular | 2B,B | A (Very soft) | B |
| Comp. Ex. 5 | 1.21 | 15 | 224 | 7.4 | 30 | (0, B/2), (0, −B/2) | Semi-circular | 2B, B | D (Extensive filament damage) | C |
| Ex. 4 | 1.15 | 10 | 98 | 7.6 | 13 | (A/4, B/2), (A/4, −B/2) | Semi-circular | 2B, B | B | B |
| Ex. 5 | 1.15 | 10 | 98 | 7.6 | 13 | (A4, B/2), (−A/4, −B/2) | Semi-circular | 2B, B | A (Very soft) | B |
| Comp. Ex. 6 | 1.15 | 10 | 98 | 7.6 | 13 | (3A/8, B/2), (0, −B/2) | Semi-circular | 2B, B | C | C |
| Ex. 6 | 1.15 | 10 | 98 | 7.6 | 13 | (A/4, B/2), (0, −B/2) | Semi-circular | 2B, B | B | B |
| Comp. Ex. 7 | 1.15 | 10 | 98 | 9.7 | 10 | Unribbed | — | — | C | C |
| Ex. 7 | 1.15 | 10 | 86 | 8.5 | 10 | (0, B/2), (0, −B/2) | Semi-circular | 2B, B | B | B |
| Comp. Ex. 8 | 1.15 | 10 | 90 | 9.0 | 10 | (0, B/2), (0, −B/2) | Semi-oval | 2B, B/3 | C | C |
| Ex. 8 | 1.15 | 10 | 88 | 8.8 | 10 | (0, B/2), (0, −B/2) | Semi-oval | 2B, B/2 | B | B |
| Ex. 9 | 1.15 | 10 | 92 | 9.2 | 10 | (0, B/2), (0, −B/2) | Semi-oval | B/2, B/2 | B | B |
| Comp. Ex. 9 | 1.15 | 10 | 84 | 8.4 | 10 | (0, B/2), (0, −B/2) | Semi-oval | 4B, B/2 | C | C |
| Comp. Ex. 10 | 1.15 | 10 | 94 | 9.4 | 10 | (0, B/2), (0, −B/2) | Semi-oval | B/3, B/2 | C | B |
| Ex. 10 | 1.15 | 10 | 88 | 8.8 | 10 | (0, B/2), (0, −B/2) | Square | B, B | B | B |
| Ex. 11 | 1.15 | 10 | 92 | 9.2 | 10 | (0, B/2), (0, −B/2) | Right triangle | B, B | B | B |
| Ex. 12 | 1.15 | 10 | 82 | 8.2 | 10 | (0, B/2), (0, −B/2) | Rectangular | 2B, B | B | B |
| Ex. 13 | 1.15 | 10 | 90 | 9.0 | 10 | (A/4, B/2), (−A/4, B/2)<br>(A/4, −B/2), (−A/4, −B/2) | Semi-circular | B, B/2 | B | B |
| Ex. 14 | 1.15 | 10 | 87 | 8.7 | 10 | (0, B/2), (0, −B/2)<br>(A/8, B/2), (−A/B, B/2)<br>(A/B, −B/2), (−A/B, −B/2) | Semi-circular | B, B/2 | B | |
| Ex. 15 | 1.15 | 10 | 87 | 8.7 | 10 | (0, B/2), (−A/8, B/2)<br>(A/8, B/2), (−A/8, −B/2)<br>(A/4, −B/2) | Semi-cicrular | B, B/2 | B | B |
| Comp. Ex. 11 | 1.01 | 5.0 | 29 | 5.8 | 7 | (A/6, B/2), (A/6, −B/2)<br>(A/3, B/2), (A/3, −B/2<br>(0, B/2), (0, −B/2)<br>(−A/3, B/2), (−A/3, −B/2)<br>(−A/6, B/2), (−A/6, −B/2) | Semi-circular | B, B/2 | C | C |

COMPARATIVE EXAMPLES 12 AND 13

In each comparative example, spinning was conducted in a similar manner as Example 2 except that the configuration of each fine spinning hole was modified at the rib-forming portions thereof. The water retention of filaments before their drying step was measured, and is shown in comparison with that of the filaments of Example 2 in Table 2.

The pre-drying water retention varies substantially depending on the rib shape, and the rib shapes of Comparative Examples 10 and 11 are expected to result in significant drying loads.

TABLE 2

| | spinning draft | Fineness | A(μ) | B(μ) | Flatness | Positions of ribs | Cross-sectional shape of ribs | Size ribs (W, H) | Water retention before drying, wt. % |
|---|---|---|---|---|---|---|---|---|---|
| Ex. 2 | 1.15 | 10 | 98 | 7.6 | 13 | (0, B/2), (0, −B/2) | Semi-circular | 2B, B | 175 |
| Comp. Ex. 12 | 1.63 | 10 | 76 | 5.8 | 13 | (0, B/2), (0, −B/2) | Rectangular | 4B, 3B | 269 |
| Comp. Ex. 13 | 1.15 | 10 | 98 | 7.6 | 13 | (0, B/2), (0, −B/2) | Rectangular | B, 3B | 308 |

EXAMPLES 16–18 & COMPARATIVE EXAMPLES 14–18

In each of the examples and comparative examples, an acrylonitrile copolymer composed of 93 wt. % of acrylonitrile and 7 wt. % of vinyl acetate and having a reduced viscosity of 2.0 was obtained by an aqueous suspension polymerization process. The acrylonitrile copolymer was then dissolved in dimethylacetamide so that a spinning solution containing the acrylonitrile copolymer at a concentration of 24 wt. % was obtained.

Through fine spinning holes of a corresponding flat cross-section configuration, the spinning solution was spun in a 40 wt. % aqueous solution of dimethylacetamide, the aqueous solution having been controlled at 40° C., while taking them up at a spinning draft of 1.01 to 1.91. The resultant filaments were stretched 5-fold in hot water, washed and then dried by drying rollers. After they were subjected to thermal relaxation treatment under a pressurized steam atmosphere of 2.5 kg/cm$^2$, crimps were applied at a population of 9.5 crimps/inch and a crimp degree of 10.3%.

The ribbed flat acrylic filaments were then cut into 51 mm lengths. In this manner, six types of flat acrylic fibers shown in Table 3 were obtained. Each of the six types was blended with the 51-mm long ribbed filaments, which had been obtained in the corresponding one of Examples 1 to 3 and Comparative Examples 2 and 4, in the proportions shown in Table 3, and slivers of 10 g/m in thickness were produced. By a sliver knitting machine, they were formed into a sliver knit. The silver knit was then subjected to polisher processing, whereby a high-pile fabric of a metsuke of 700 g/m$^2$ and a pile length of 8 mm was obtained. Evaluation results of this high-pile fabric are also shown in Table 3.

stretched 5-fold in boiling water while washing off the solvent, followed by drying through hot rollers controlled at 150° C. After they were subjected to thermal relaxation treatment in pressurized steam of 2.5 kg/cm$^2$, crimps were applied at a population of 9.5 crimps/inch and a crimp degree of 10.3%. In this manner, different types of ribbed flat acrylic filaments, which were different in fineness and flatness as shown in Table 4, were obtained. Each type of ribbed flat acrylic filaments was then cut into 51 mm lengths to provide raw fibers.

Further, spinning was also performed likewise through fine circular holes. After the resultant filaments were subjected to thermal relaxation treatment in pressurized steam, they were stretched 1.5-fold in steam of normal pressure, thereby obtaining shrinkable acrylic fibers having a broad-bean-shaped cross-section [fineness: 2 denier, a/b=2.6, number of indentation(s): 1]. The shrinkage factor of these fibers was 26% when measured by treating them for 3 minutes in boiling water and 17% when measured by treating them for 10 minutes at 130° C. dry heat. These fibers were cut into 38 mm lengths to provide conventional raw fibers of shrinkable acrylic fibers.

Additional spinning was also performed likewise through the same fine circular holes. The resultant fibers were subjected only to pressurized steam treatment, thereby obtaining shrinkable acrylic fibers having a broad-bean-shaped cross-section [fineness: 5 denier, a/b=2.6, number of indentation(s): 1]. These fibers were cut into 38 mm lengths to provide conventional raw fibers of shrinkable acrylic fibers.

TABLE 3

| | Ribbed flat acrylic filaments | | Flat Acrylic Filaments | | | | | Feeling | |
|---|---|---|---|---|---|---|---|---|---|
| | Filaments | Blending Proportion (wt. %) | Fineness (denier) | A ($\mu$) | B ($\mu$) | Flatness | Blending Proportion (wt. %) | Surface Feeling | Resiliency, Substantial feeling |
| Ex. 16 | Ex. 1 | 30 | 10 | 110 | 8.5 | 13 | 70 | A (very soft) | B |
| Comp. Ex. 14 | Ex. 1 | 5 | 10 | 110 | 8.5 | 13 | 95 | C | C |
| Ex. 17 | Ex. 3 | 30 | 15 | 170 | 8.4 | 20 | 70 | A (very soft) | B |
| Comp. Ex. 15 | Ex. 3 | 30 | 15 | 206 | 6.9 | 30 | 70 | C | D |
| Ex. 18 | Ex. 2 | 30 | 5 | 61 | 7.7 | 8 | 70 | A (very soft) | B |
| Comp. Ex. 16 | Comp. Ex. 4 | 30 | 5 | 61 | 7.7 | 8 | 70 | D (rough feeling) | E |
| Comp. Ex. 17 | Comp. Ex. 2 | 50 | 2 | 30 | 6.2 | 5 | 50 | B | C |
| Comp. Ex. 18 | Comp. Ex. 2 | 50 | 0.5 | 15 | 3.1 | 5 | 50 | E (very rough feeling) | E |

EXAMPLES 19–23 AND COMPARATIVE EXAMPLES 19–22

In each of the examples and comparative examples, a spinning solution of the same composition as that employed in Example 16 was spun into a 40 wt. % aqueous solution of dimethylacetamide, said aqueous solution having been controlled at 40° C., through fine spinning holes of a configuration similar to the cross-sectional shape of the desired filaments. The resultant filaments were then The above-obtained three types of raw fibers were blended together in proportions such that the ribbed flat acrylic filaments, the shrinkable fibers and the conventional acrylic fibers accounted for 40 wt. %, 40 wt. %, and 20 wt. %, respectively, and slivers of 20 g/m in thickness were then produced. By a sliver knitting machine, they were formed into a sliver knit. subsequent to shrinking treatment, the silver knit was subjected to polisher processing, whereby a high-pile fabric of a metsuke of 700 g/m$^2$ and a pile length of 18 mm was obtained. Its feeling was ranked and is also shown in Table 4.

TABLE 4

| | Ribbed Flat Acrylic Filaments | | | | | | Shrinkable acrylic fibers | Non-shrinkable acrylic fibers | Feeling of high-pile fabric | |
|---|---|---|---|---|---|---|---|---|---|---|
| | Finess (denier) | Flatness | Positions of ribs | Cross-sectional shape of ribs | Size of ribs (W, H) | Blending Proportion (wt. %) | Blending proportion (wt. %) | Blending proportion (wt. %) | Surface feeling | Resiliency, substantial feeling |
| Comp. Ex. 19 | 1 | 5 | (0, B/2), (0, −B/2) | Semi-circular | 2B, B | 40 | 40 | 20 | D | B |
| Ex. 19 | 5 | 7 | (0, B/2), (0, −B/2) | Semi-circular | 2B, B | 40 | 40 | 20 | A | A |
| Ex. 20 | 15 | 20 | (0, B/2), (0, −B/2) | Semi-circular | 2B, B | 40 | 40 | 20 | A | A |
| Comp. Ex. 20 | 15 | 30 | (0, B/2), (0, −B/2) | Semi-circular | 2B, B | 40 | 40 | 20 | D | B |
| Ex. 21 | 10 | 13 | (0, B/2), (0, −B/2) | Semi-circular | 2B, B | 40 | 40 | 20 | A | A |
| Ex. 22 | 10 | 13 | (A/4, B/2), (A/4, −B/2) | Semi-circular | 2B, B | 40 | 40 | 20 | B | A |
| Comp. Ex. 21 | 10 | 13 | Unribbed | — | —, — | 40 | 40 | 20 | C | B |
| Comp. Ex. 22 | 10 | 13 | (0, B/2), (0, −B/2) | Semi-oval | 2B, B/3 | 40 | 40 | 20 | C | B |
| Ex. 23 | 10 | 13 | (0, B/2), (0, −B/2) | Square | B, B | 40 | 40 | 20 | B | A |

EXAMPLES 24–31 & COMPARATIVE EXAMPLES 23–25

In each of the examples and comparative examples, the same acrylonitrile copolymer as in Example 1 was dissolved in dimethylacetamide so that a spinning solution containing the acrylonitrile copolymer at a concentration of 25 wt. % was obtained.

The spinning solution was spun into a 40 wt. % aqueous solution of dimethylacetamide, the aqueous solution having been controlled at 40" c., through fine spinning holes of a configuration similar to the cross-sectional shape of the desired fibers. The resultant fibers were then stretched 5-fold in boiling water while washing off the solvent, followed by drying through hot rollers controlled at 150° C.

After they were subjected to thermal relaxation treatment in pressurized steam of 2.5 kg/cm$^2$. In this manner, four types of fibers which had edge-free cross-sectional shapes and were different in shape [a/b, number of indentation(s)] were obtained. Each type of fibers was then stretched 1.5-fold in steam of normal pressure, whereby shrinkable acrylic fibers having a fineness of 2 denier were obtained. The shrinkage factor of these filaments was 27% when measured by treating them for 3 minutes in boiling water and 18% when measured by treating them for 10 minutes at 130° C. dry heat. These fibers were cut into 18 mm lengths to provide raw fibers of shrinkable acrylic fibers.

In a similar manner as described above, spinning was performed through the fine circular holes and the resultant fibers were subjected to the treatment or processing up to the pressurized steam treatment, whereby conventional acrylic fibers having a fineness of 5 denier were obtained. These fibers were cut into 38 mm lengths to provide conventional raw fibers of acrylic fibers.

The above-obtained two types of raw fibers were blended with the ribbed flat acrylic filaments [fineness: 10 denier, flatness: 13], which had been obtained in Example 1, in proportions shown in Table 5, whereby slivers of 10 g/m in thickness were produced. By a sliver knitting machine, they were formed into a sliver knit. Subsequent to shrinking treatment, the silver knit was subjected to polisher processing, whereby a high-pile fabric of a metsuke of 700 g/m$^2$ and a pile length of 18 mm was obtained. Its evaluation results are also shown in Table 5.

TABLE 5

| | Ribbed flat acrylic filaments | | Shrinkable acrylic fibers | | | Non-shrinkable fibers | Feeling of high-pile fabric | |
|---|---|---|---|---|---|---|---|---|
| | Filaments | Blending Proportion (wt. %) | a/b | Number of indentations | Blending proportion (wt. %) | Blending proportion (wt. %) | Surface feeling | Resiliency, substantial feeling |
| Ex. 24 | Same as Ex. 1 | 40 | 2.6 | 2 | 40 | 20 | A | A |
| Ex. 25 | Same as Ex. 1 | 40 | 3.4 | 2 | 40 | 20 | A | A |
| Ex. 26 | Same as Ex. 1 | 40 | 6.1 | 2 | 40 | 20 | A | B |
| Ex. 27 | Same as Ex. 1 | 40 | 6.1 | 0 | 40 | 20 | A | B |
| Comp. Ex. 23 | Same as Ex. 1 | 70 | 3.4 | 2 | 30 | 0 | A | C |
| Ex. 28 | Same as Ex. 1 | 55 | 3.4 | 2 | 45 | 0 | A | A |
| Ex. 29 | Same as Ex. 1 | 50 | 3.4 | 2 | 30 | 20 | A | A |
| Comp. Ex. 24 | Same as Ex. 1 | 40 | 3.4 | 2 | 60 | 0 | C | B |
| Ex. 30 | Same as Ex. 1 | 30 | 3.4 | 2 | 30 | 40 | B | B |
| Ex. 31 | Same as Ex. 1 | 25 | 3.4 | 2 | 30 | 45 | B | B |
| Comp. Ex. 25 | Same as Ex. 1 | 15 | 3.4 | 2 | 45 | 45 | D | C |

EXAMPLE 32

The filaments obtained in Example 27, which had an edge-free cross-sectional shape [a/b=3.4, number of indentations: 2], were stretched 1.5-fold in steam of normal pressure subsequent to their treatment in pressurized steam, whereby shrinkable acrylic fibers having a fineness of 2 denier were obtained. The shrinkage factor of these fibers was 27% when measured by treating them for 3 minutes in boiling water and 18% when measured by treating them for 10 minutes at 130° C. dry heat. These fibers were cut into 38 mm lengths to provide raw fibers.

In a similar manner as described above, spinning was performed and the resultant fibers were subjected to post treatment or processing up to the pressurized steam treatment, whereby non-shrinkable acrylic fibers having a similar edge-free cross-sectional shape [a/b=3.7, number of indentations: 2] and a fineness of 5 denier were obtained. These fibers were cut into 38 mm lengths to provide raw fibers.

The above-obtained two types of raw fibers were blended with the ribbed filaments of the flat cross section [fineness: 10 denier, flatness: 13], which had been obtained in Example 1, in proportions such that the ribbed flat acrylic filaments, the shrinkable acrylic fibers and the non-shrinkable acrylic fibers accounted for 30 wt. %, 40 wt. %, and 30 wt. %, respectively, and slivers of 10 g/m in thickness were then produced. By a sliver knitting machine, they were formed into a sliver knit. The sliver knit was subjected to shrinking treatment for 5 minutes at 130° C. dry heat and then to shrinking treatment, whereby a high-pile fabric of a metsuke of 700 g/m$^2$ and a pile length of 18 mm was obtained. A surface of this high-pile fabric has soft feeling and also had excellent resiliency and substantial feeling. It was therefore a pile fabric of very high quality.

The ribbed flat filaments according to the present invention have excellent brushing effect and bulkiness, permit easy elimination of crimps by polishing and, when formed into a pile product, provide not only soft feeling but also resilient and substantial feeling. They are hence suited as raw fibers for a pile fabric. The raw fibers according to the present invention for the pile fabric exhibit still softer feeling when formed into the pile fabric. Further, the shrinkable-filament-blended raw fibers for a pile fabric according to the present invention obviate blending of raw fibers subjected to special treatment such as application of an aminosiloxane softener, and can be formed into a pile product equipped with not only soft surface feeling but also excellent resiliency and substantial feeling, all of which are highly comparable with those of natural furs.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiment (s) without materially departing from the novel teachings and advantages of this invention. Accordingly, all such modifications are intended to be included within the scope of this invention as defined in the following claims, In the claims, means-plus-function clauses are intended to cover the structures described herein as performing the recited function and not only structural equivalents but also equivalent structures, This although a nail and screw may not be structural equivalents in that a nail relies entirely on friction between a wooden part and a cylindrical surface whereas a screw's helical surface positively engages the wooden part in the environment of fastening wooden parts, a nail and a screw may be equivalent structures.

What is claimed is:

1. A flat filament having a substantially rectangular transverse cross-section, wherein said filament includes:

a flatness ratio (A/B) of 7 to 25, wherein A is a length of a longer side of said substantially rectangular, transverse cross-section, and B is a length of a shorter side of said substantially rectangular, transverse cross section;

a fineness of 0.5 to 40 denier;

at least one rib formed on said longer side, said at least one rib continuously extending in a longitudinal direction of said filament; and each of said at least one rib having a width W and a height H, the number of said ribs on each longer side ranging from 1 to A/2W, said width W ranging from B/2 to 3B, and said height H ranging from B/2 to 2B.

2. The flat filament according to claim 1, wherein a midpoint of said width W of each of said at least one rib is located within a distance of A/4 from a midpoint of said respective longer side.

3. The flat filament according to claim 1, wherein said flatness ratio (A/B) ranges from 7 to 15.

4. The flat filament according to claim 1, wherein said fineness ranges from 3 to 20 denier.

5. The flat filament according to claim 1, wherein the number of ribs on each longer side is 1.

6. The flat filament according to claim 1, wherein each rib has a shape defined only by edge free curves as viewed in said transverse cross-section of said filament.

7. The flat filament according to claim 1, wherein said flat filament is composed of an acrylic material.

8. Raw fibers for manufacture of a pile fabric, said raw fibers comprising:

at least 10 wt. % of a first ribbed flat filament having a first substantially rectangular transverse cross-section, wherein said first ribbed flat filament includes:

a flatness ratio (A/B) of 7 to 25, wherein A is a length of a longer side of said first substantially rectangular, transverse cross-section, and B is a length of a shorter side of said first substantially rectangular, transverse cross section;

a fineness of 0.5 to 40 denier;

at least one rib formed on said longer side, said at least one rib continuously extending in a longitudinal direction of said filament;

each of said at least one rib having a width W and a height H, the number of said ribs on each longer side ranging from 1 to A/2W, said width W ranging from B/2 to 3B, and said height H ranging from B/2 to 2B; and not more than 90 wt. % of a second flat filament having a second substantially rectangular transverse cross-section, wherein said second flat filament includes:

a flatness ratio (A'/B') of 5 to 25, A' being a length of a longer side of said second substantially rectangular, transverse cross-section, and B' being a length of a shorter side of said second substantially rectangular, transverse cross-section; and a fineness of 1 to 40 denier.

9. The raw fibers according to claim 8, wherein said second flat filament has a fineness of 2 to 30 denier.

10. The raw fibers according to claim 8, wherein said second flat filament has a fineness of 5 to 15 denier.

11. Raw fibers for a pile fabric, said raw fibers comprising:

20 to 60 wt. % of a first ribbed flat filament having a first substantially rectangular transverse cross-section, wherein said first ribbed flat filament includes:

a flatness ratio (A/B) of 7 to 25, wherein A is a length of a longer side of said first substantially rectangular, transverse cross-section, and B is a length of a shorter side of said first substantially rectangular, transverse cross section;

a fineness of 0.5 to 40 denier;

at least one rib formed on said longer side, said at least one rib continuously extending in a longitudinal direction of said filament;

each of said at least one rib having a width W and a height H, the number of said ribs on each longer side ranging from 1 to A/2W, said width W ranging from B/2 to 3B, and said height H ranging from B/2 to 2B;

20 to 50 wt. % of a shrinkable fiber having a shrinkage factor of at least 15% and a fineness of 1 to 5 denier; and 60 wt % or less of a non-shrinkable fiber.

12. The raw fibers according to claim 11, wherein each of said shrinkable fiber has a transverse cross-section defined only by edge-free curves, defines at least two indentations at different locations as viewed in the transverse cross-section, and satisfies the following formula:

$$2 \leqq a/b \leqq 5$$

where, when said transverse cross-section is sandwiched between two parallel straight lines, a is a maximum distance between said two parallel straight lines and b is a minimum distance between said two parallel straight lines.

13. The raw fibers according to claim 11, wherein each of said non-shrinkable fibers has a transverse cross-section defined only by edge-free curves, defines at least two indentations at different locations as viewed in the transverse cross-section, and satisfies the following formula:

$$2 \leqq a/b \leqq 5$$

where, when said transverse cross-section is sandwiched between two parallel straight lines, a is a maximum distance between said two parallel straight lines and b is a minimum distance between said two parallel straight lines.

14. The raw fibers according to claim 11, wherein said shrinkable fibers are acrylic fibers.

15. The raw fibers according to claim 11, wherein said non-shrinkable fibers are acrylic fibers.

* * * * *